US008013825B2

(12) United States Patent
Lebrun et al.

(10) Patent No.: US 8,013,825 B2
(45) Date of Patent: Sep. 6, 2011

(54) VIDEO SYSTEM INCLUDING A LIQUID CRYSTAL MATRIX DISPLAY HAVING A PRECHARGE PHASE WITH IMPROVED ADDRESSING METHOD

(75) Inventors: Hugues Lebrun, Coublevie (FR); Thierry Kretz, Saint Jean de Moirans (FR)

(73) Assignee: Thales, Neuilly sur Seine (FR)

( * ) Notice: Subject to any disclaimer, the term of this patent is extended or adjusted under 35 U.S.C. 154(b) by 408 days.

(21) Appl. No.: 12/096,381

(22) PCT Filed: Dec. 6, 2006

(86) PCT No.: PCT/EP2006/069352

§ 371 (c)(1),
(2), (4) Date: Oct. 3, 2008

(87) PCT Pub. No.: WO2007/065903

PCT Pub. Date: Jun. 14, 2007

(65) Prior Publication Data

US 2009/0167964 A1 Jul. 2, 2009

(30) Foreign Application Priority Data

Dec. 7, 2005 (FR) ..... 05 12411

(51) Int. Cl.
*G09G 3/36* (2006.01)

(52) U.S. Cl. ..... 345/90

(58) Field of Classification Search ..... 345/90
See application file for complete search history.

(56) References Cited

U.S. PATENT DOCUMENTS

| | | | | |
|---|---|---|---|---|
| 6,064,713 | A | 5/2000 | Lebrun et al. | |
| 6,359,608 | B1 | 3/2002 | Lebrun et al. | |
| 6,611,311 | B1 | 8/2003 | Kretz et al. | |
| 2002/0057238 | A1 * | 5/2002 | Nitta et al. | 345/87 |
| 2002/0158823 | A1 * | 10/2002 | Zavracky et al. | 345/87 |
| 2004/0041768 | A1 | 3/2004 | Chen et al. | |
| 2004/0140985 | A1 * | 7/2004 | Liaw | 345/690 |
| 2004/0178977 | A1 * | 9/2004 | Nakayoshi et al. | 345/87 |
| 2005/0225545 | A1 * | 10/2005 | Takatori et al. | 345/204 |
| 2005/0237291 | A1 * | 10/2005 | Aoki | 345/100 |
| 2005/0253826 | A1 * | 11/2005 | Yang | 345/204 |
| 2007/0252780 | A1 | 11/2007 | Lebrun et al. | |

FOREIGN PATENT DOCUMENTS

| | | |
|---|---|---|
| EP | 0 478 186 | 4/1992 |

* cited by examiner

*Primary Examiner* — Chanh Nguyen
*Assistant Examiner* — Long Pham
(74) *Attorney, Agent, or Firm* — Oblon, Spivak, McClelland, Maier & Neustadt, L.L.P.

(57) ABSTRACT

In a method for addressing rows and columns in a liquid crystal display, each phase for addressing rows and columns in the display includes precharging pixels of the display before a row write, to apply a precharge voltage to all pixels. Depending on the selected black or white precharge level, the light box is either switched on permanently, or is switched on during each addressing phase immediately after the precharge or immediately after the row write. The display brightness is thus improved. The display may be of sequential color type.

19 Claims, 5 Drawing Sheets

VIDEO SYSTEM INCLUDING A LIQUID CRYSTAL MATRIX DISPLAY HAVING A PRECHARGE PHASE WITH IMPROVED ADDRESSING METHOD

FIELD OF THE INVENTION

This invention relates to a method for controlling the display of pixels for an active matrix liquid crystal display and more particularly an addressing method in sequential colour mode.

One advantage of sequential colour mode is that colour display systems can be made for direct viewing screens without coloured filters, in other words without any colour information attached to an image point or pixel. Each pixel is then colourless and a light box is used that lights up the display in three primary colours in sequence.

DISCUSSION OF THE BACKGROUND

The invention is particularly applicable to the direct viewing screens market: from cell phone screens to large television screens. It is more particularly applicable to displays for which pixels are controlled analogically. In a corresponding addressing method, the video to be displayed on a pixel is controlled by an analogue voltage level output by a digital analogue converter using the received digital video signal. To display a given grey level, the active element of a pixel is activated for one row period to transfer a corresponding analogue voltage level onto the pixel capacitance. The liquid crystal is then oriented in a direction that depends on the applied analogue value. Input light bias passing through this liquid crystal is then modified and analysed by a polariser.

The display performance depends particularly on the brightness that depends on the pixel illumination time. This illumination time depends on the addressing time necessary to transfer analogue voltage levels onto each pixel in a row of the matrix, and the liquid crystal stabilization time that depends on the previous analogue voltage level and the current analogue voltage level.

These constraints are accentuated in the case of a display addressed in sequential colour mode. Remember that in a display, the pixels are organised in rows and columns of a matrix, each pixel being arranged at the intersection of a row and a column. The rows of cells are addressed sequentially. The cells in a row are addressed simultaneously and receive new analogue data through columns during the row time (in other words the time during which the associated row is selected). An addressing phase of a display normally includes a write step during which rows are selected sequentially, and the active elements of each selected row are activated to receive and transfer the analogue voltage level onto the associated pixel capacitance, with a stabilization time corresponding to the changeover time necessary so that all pixels are switched; and an illumination time during which the panel is illuminated, the light is modulated by the display and the corresponding image is recovered. In the case of a sequential colour mode, these steps are performed once for each primary colour within a particular video frame. There are generally three coloured sub-frames per frame. Thus, within the time of one frame, all pixels in the matrix have to be addressed at least three times to display the video information corresponding to each primary colour. It may be necessary to have two or more coloured sub-frames per primary colour in a video frame, to avoid perceiving the different coloured frames.

There are still some problems that arise with these displays, particularly due to the liquid crystal response time that depends on the analogue voltage level memorized during the previous sub-frame and the analogue voltage level to be charged during the new sub-frame. Taking the example of a TN (Twisted Nematic) type liquid crystal display, the changeover time for the liquid crystal to change from one grey level to another is much greater than the changeover time to change from the black level to the white level, or from the white level to a grey level. The black level is the liquid crystal mode in which the potential difference between the pixel and the counter electrode is maximum. The white level is the liquid crystal mode in which the potential difference between the pixel and the counter electrode is minimum. A grey level is an intermediate level: light greys correspond to an applied potential difference similar to the value applied to obtain white, while dark greys correspond to a potential difference similar to that applied to obtain black. The changeover time to change from the white level to a light grey level may be one and a half times longer than the changeover time to change from the black level to this same light grey level. The changeover time from a light grey level to the black level is very short. In one example with TN type liquid crystals, the following changeover times were measured: 0.2 milliseconds to change from white to black; 1 millisecond to change from black to white; 3.25 milliseconds in the worst case measured between two grey levels.

SUMMARY OF THE INVENTION

The invention attempts to improve the performances of a liquid crystal display. In particular, an attempt is made to improve the brightness of the display. One means of improving the brightness is to increase the panel illumination time during every panel addressing phase.

An attempt is also made to improve the performances of a liquid crystal display of the colour sequential type for which the colour display frequency is increased to solve the well known colour break-up problem, particularly due to the liquid crystal stabilisation time. For example there are two coloured sub-frames for each primary colour in each video frame. The upper addressing time limit of the display is fixed by the duration of the video frame. Doubling the video frequency is equivalent to halving the duration of the video frame, which causes problems. In particular, the pixels of the last two rows of the panel may not have sufficient time to reach their new video level set value. If the previous addressing phase corresponds to a red sub-frame, in the next sub-frame, for example the green sub-frame, the bottom of the panel may still contain some data corresponding to the previous red sub-frame.

It can be seen that to solve these different problems, it is useful to reduce the time necessary for addressing cells, in other words reduce the duration of the writing and stabilization steps so as to have a longer illumination time and therefore improve the brightness, and so as to be able to multiply the number of coloured sub-frames in each video frame, so as to reduce the stroboscopic effect due to the light box switching on and switching off frequency.

One purpose of the invention is a process for addressing a liquid crystal display in which the performances of the display are improved.

One purpose of the invention is an addressing method based on display control devices and that requires very few modifications.

Another purpose of the invention is a colour projection system with a single liquid crystal display panel.

Therefore the invention relates to a video system with a method of addressing the rows and columns of a liquid crystal display to apply video information on each pixel of the display, in which a video frame comprises at least one addressing phase of the rows in the panel, said phase comprising:

a write rows step, containing a phase for each row to select said row during a row time and apply an analogue voltage level ($V_1$, . . . $V_n$), corresponding to image data to be displayed, on each pixel in the selected row;

an illumination step by a light box to illuminate said pixels, a step to precharge the pixels in the display before said writing step, to apply a precharge voltage onto all pixels.

A precharge circuit activated in a precharge step at the beginning of each addressing phase of the rows in the panel, is used to select all rows in the panel simultaneously, and to apply a precharge voltage onto all columns simultaneously. It comprises a plurality of row transistors to select all rows simultaneously and a plurality of column transistors to apply the precharge voltage onto all columns simultaneously.

The display is advantageously of the colour sequential type.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention.

Accordingly, the drawings and description thereof are to be regarded as illustrative in nature, and not as restrictive.

DESCRIPTION OF THE PREFERRED EMBODIMENT

Figure 1:
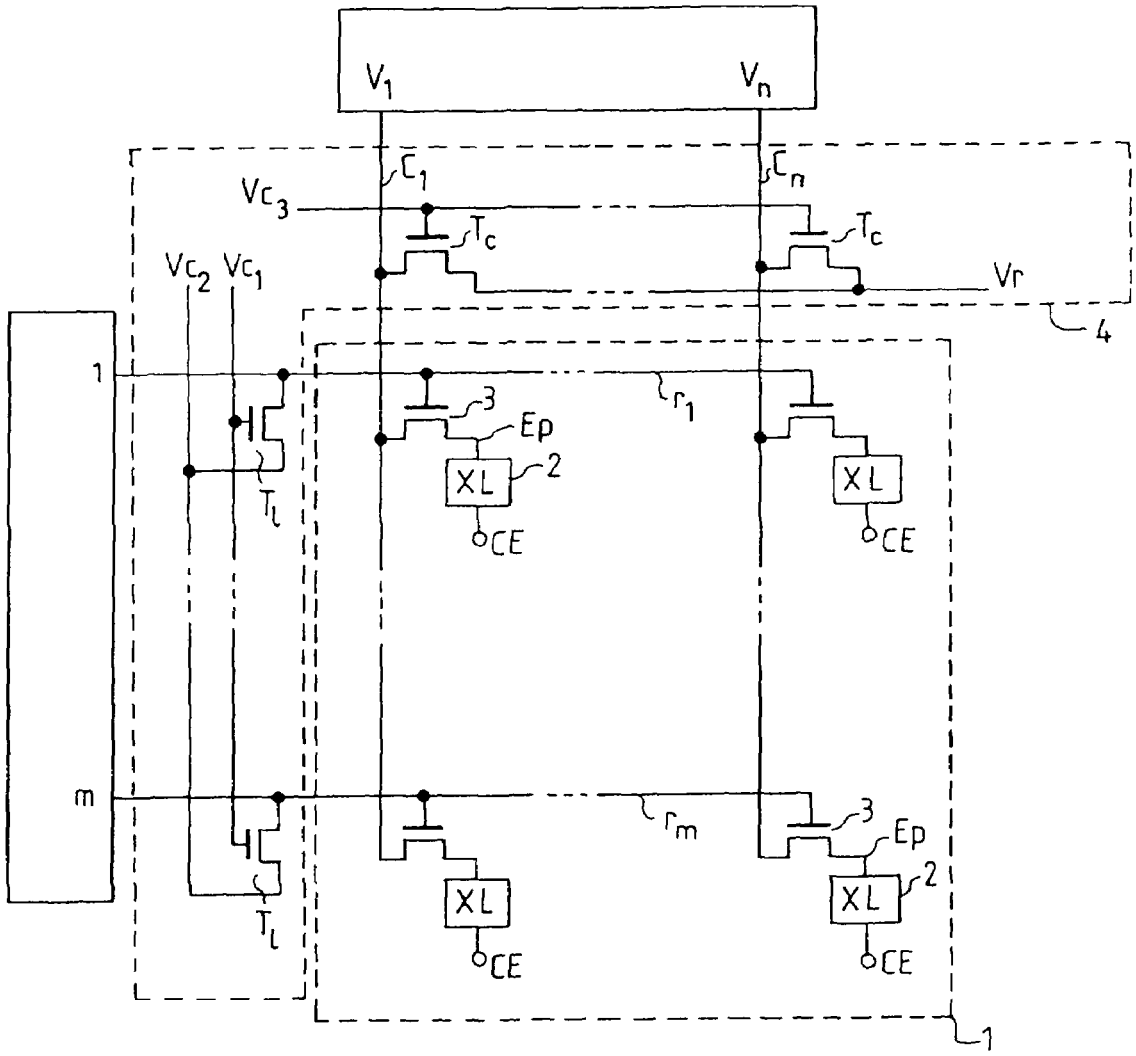
FIG. 1 illustrates an LCD display panel according to the invention.

FIG. 1 illustrates a block diagram of an LCD display with an active matrix panel 1. It comprises a substrate supporting transistors and pixel electrodes, a second substrate that may or may not comprise coloured filters and a counter electrode CE common to all pixels in the panel, that may or may not be placed on the coloured filters. The two substrates are approximately parallel and are at a spacing from each other, with liquid crystal in this space between the two substrates between the counter electrode and the active matrix.

The panel is composed of m rows $r_1$ to $r_m$ each comprising n display elements or pixels 2 and n columns $c_1$ to $c_n$ with m pixels 2 in each column. Each pixel has an associated active element, in the example a transistor 3. Normally, the gate electrodes of the transistors in the same row are connected in common to the conductor of rows $r_1$, . . . $r_m$ and the source conducting or drain conducting electrodes of the transistors in the same column are connected in common to the conductor of columns $c_1$, . . . $c_n$, the other electrode being connected to a pixel electrode Ep of the associated pixel 2.

Addressing of each row in the panel 1 consists of applying a gate voltage onto the associated row conductor during a row addressing time $t_l$ (or row time). The effect of this is to put all transistors 3 on this row into the ON (conducting) state. The video information present on the n columns is transferred onto the pixel electrodes Ep.

During each addressing phase corresponding to an input flow of n data to be written in the pixels of the panel, each row is thus addressed during one row time, so that all rows in the display panel are scanned.

Addressing is normally done in sequence, row after row. Other row addressing modes are possible. In particular, the rows in a panel may be distributed in different groups, such that it is possible to address several rows in write simultaneously.

An addressing phase may correspond to a video frame, or a coloured sub-frame in the case of a colour sequential display.

Figure 2:
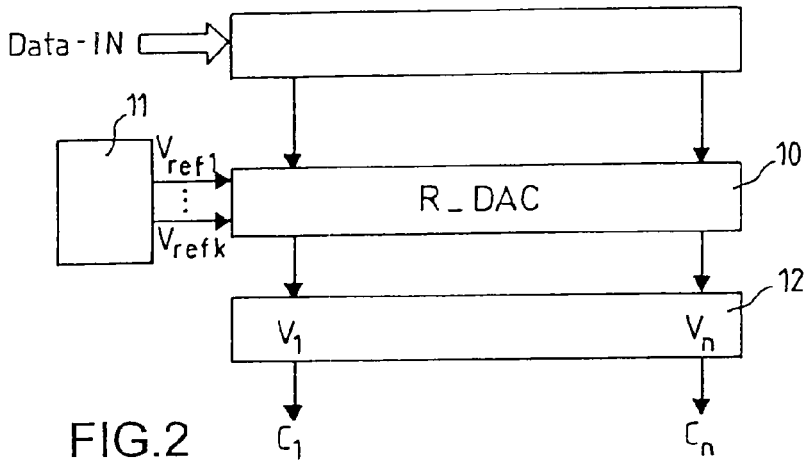
FIG. 2 is a block diagram of a device for control of the columns in the panel according to the state of the art.

As shown diagrammatically in FIG. 2, the video information applied to the columns consists of a set of analogue voltage levels, one per column, $V_1$ to $V_n$, corresponding to the flow of input digital video signals (DataIN). This set of analogue voltage levels is output by a digital analogue converter 10. In one example of a known architecture, this converter is of the R-DAC type, in other words it uses a voltage reference circuit 11 that outputs k reference analogue voltage levels $V_{ref1}$ to $V_{refk}$ and a string of resistances in series that creates resistive dividing bridges with I stages between each reference level, to output analogue voltage levels $V_1$ to $V_n$. The converter sets up bijection between each digital code received at the input and an analogue voltage level $V_1$ to $V_n$. The number of grey levels in the panel is equal to $(k-1)\cdot I$ or $(k-1)\cdot I/2$ depending on the chosen addressing mode. For each series of digital data in the input flow DataIN corresponding to the data for one row on the display, the converter 10 firstly outputs a set of n analogue voltage levels $V_1$ to $V_n$, through an amplifier device 12, and these levels are applied to the columns $c_1$ to $c_n$.

Figure 3:
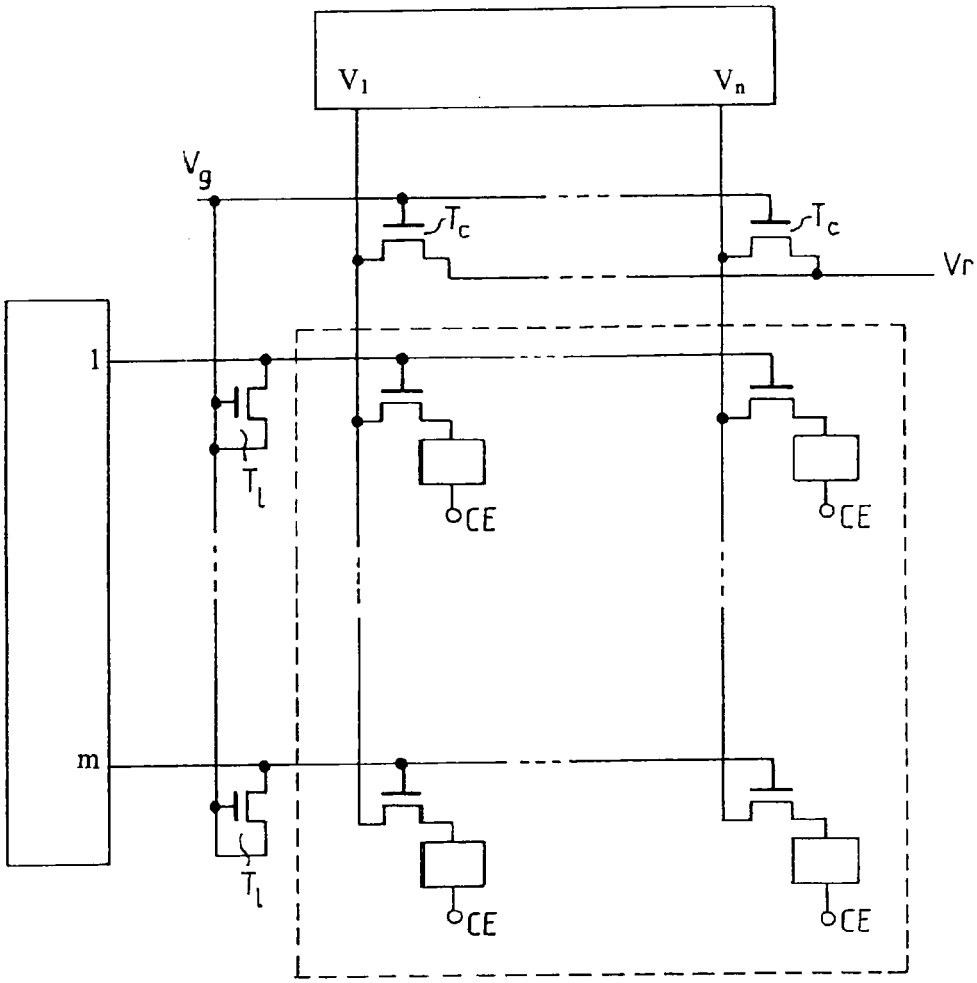
FIG. 3 illustrates a variant of the LCD display panel according to the invention.

According to the invention and as shown in FIG. 1, the display comprises a precharge circuit 4 of pixels 2 on the panel 1. This pre-charging circuit comprises m precharge transistors TI associated with the rows, one per row, and n precharge transistors Tc associated with the columns, one per column. The precharge transistors TI associated with the rows have a conducting electrode connected to the associated row conductor, the other conducting electrode being connected to a first conductor common to all precharge transistors (FIG. 1), or to the gate electrode (FIG. 3). The gate electrode is connected to a second conductor common to all precharge transistors. The precharge transistors Tc associated with the columns have a conducting electrode connected to the associated column conductor. The other conducting electrode is connected to a first conductor common to all precharged transistors. The gate electrode is connected to a second conductor common to all precharge transistors.

In the precharge step, the gates of the row precharge transistors Ti are brought to a control voltage $Vc_1$. Their common conducting electrodes are brought to a control voltage $Vc_2$, such that all rows $r_1$ to $r_m$ are selected simultaneously. This control mode of the row precharge transistors Ti advantageously inverts the polarity of the precharge voltage $V_r$ for each addressing phase. This can give a zero average voltage on the liquid crystal and prevents marking of the panels.

In another variant embodiment, the precharge transistors are replaced by a diode. This may be obtained simply as shown in FIG. 3 with transistors TI, by short circuiting their gate with the conducting electrode that was previously connected to $Vc_2$. The advantage of this variant is that it only requires a single precharge control voltage to control the conducting or blocked state of this diode. In the example, the gate voltage applied onto the transistors TI and Tc is the same voltage denoted Vg. If it is required to reverse the polarity of the precharge voltage, a second diode will be necessary such that there is always a conducting diode, depending on the polarity of the precharge voltage (not shown).

In this precharge step, the gates of the column precharge transistors Tc are raised to a control voltage $Vc_3$ (FIG. 1) or Vg (FIG. 3) and their common conducting electrodes are brought to a precharge voltage Vr such that all columns $c_1$ to $c_n$ are at the same precharge voltage level equal to approximately Vr.

It will be noted that the usage rate of row and column precharge transistors is very small. They are only active once per addressing phase. Their activation time and the precharge voltage level Vr are adjusted in practice according to the parameters of the liquid crystal of the display, according to the operating temperature of the display. Their characteristics change during time in practically the same way as transistors 3 associated with the pixels.

According to a first embodiment of the invention, the precharge level Vr corresponds to the white level, namely typically 0 volt. In this embodiment, we have already seen that changeover from black to white or from a grey level to the white level is slow. The precharge duration is determined accordingly. But the write step that follows is fast because it consists of a change from a white level for all pixels, to any other level (white, grey or black).

According to a second embodiment of the invention, the precharge level Vr corresponds to the black level, namely typically of the order of 6 volts. In this embodiment, we have already seen that the changeover from white to black or from a white level to a grey level is fast. Furthermore, it is easy to use a so-called "overdrive" pixel control mode. In this mode, voltage levels applied onto the pixels are overvalued compared with the required target value, such that this target value is exceeded and the switching time of the liquid crystal has the effect of bringing the voltage level on the pixel back to the target value at the end of switching. This is easy to implement because the pixel is precharged to the black level. Therefore the starting point for each pixel is always the same known level, black. This black level generally corresponds to 6 volts. Assume that the new objective is a given grey level that is normally obtained with a voltage of 3 volts on the pixel with the applied grey scale. With the overdrive technique, a voltage of 2.5 volts is applied onto the pixel instead of 3 volts to force switching of the liquid crystal: the pixel will charge to 2.5 volts faster than it would have charged to 3 volts.

The 2.5 volt level is determined such that the switching delay of the liquid crystal increases the level on the pixel from 2.5 volts to the required 3 volts at the end of switching. There are two effects: switching is accelerated and voltage dilution during switching of the liquid crystal is avoided. In practice, it is also planned that the set of reference analogue voltage levels that codes the grey scale determined for the panel is chosen so as to enable an overdrive type pixel control mode.

According to this second embodiment of the invention, the precharge duration is shorter with a precharge to the black level. It may be less than 0.2 milliseconds. The following write step is then slower than in the first embodiment, since the objective is to change from a high black level (6 volts) for all pixels, to a variable level: white, grey or black. But it is better controlled and faster than in prior art without precharging.

An addressing phase according to the invention then comprises a precharge step during a duration tp, followed by a write step with duration tw.

The addressing phase once again comprises a step in which the pixels panel is illuminated.

Figure 4A:
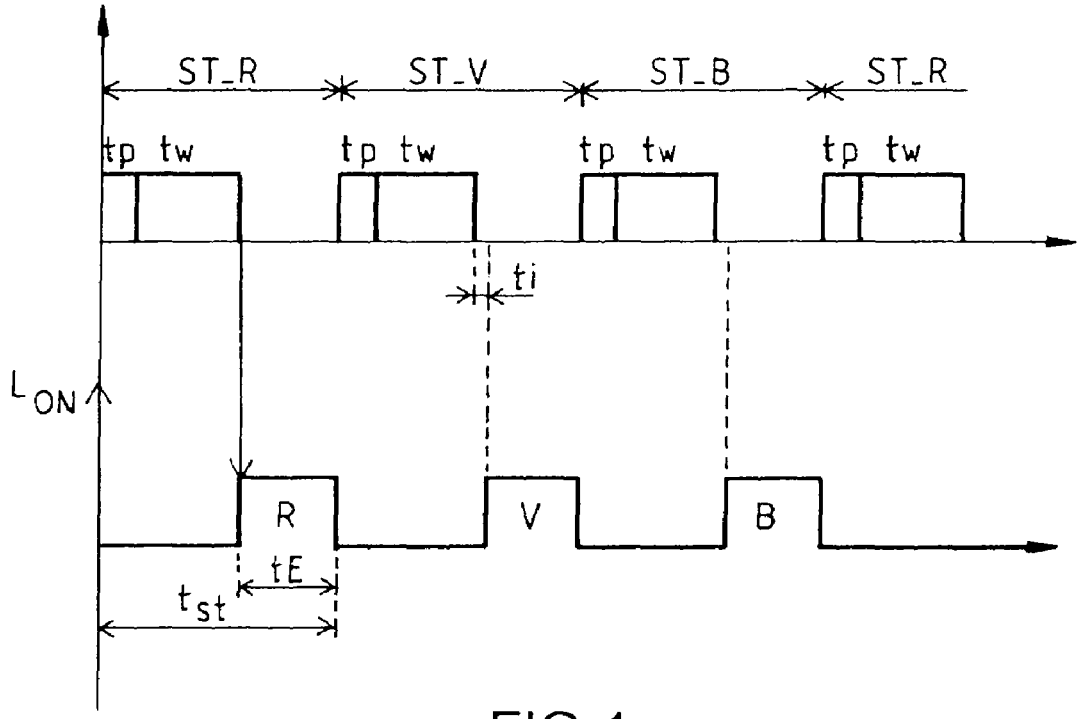
FIGS. 4*a* and 4*b* illustrate an addressing process according to a first and second embodiments of the invention.
Figure 4B:
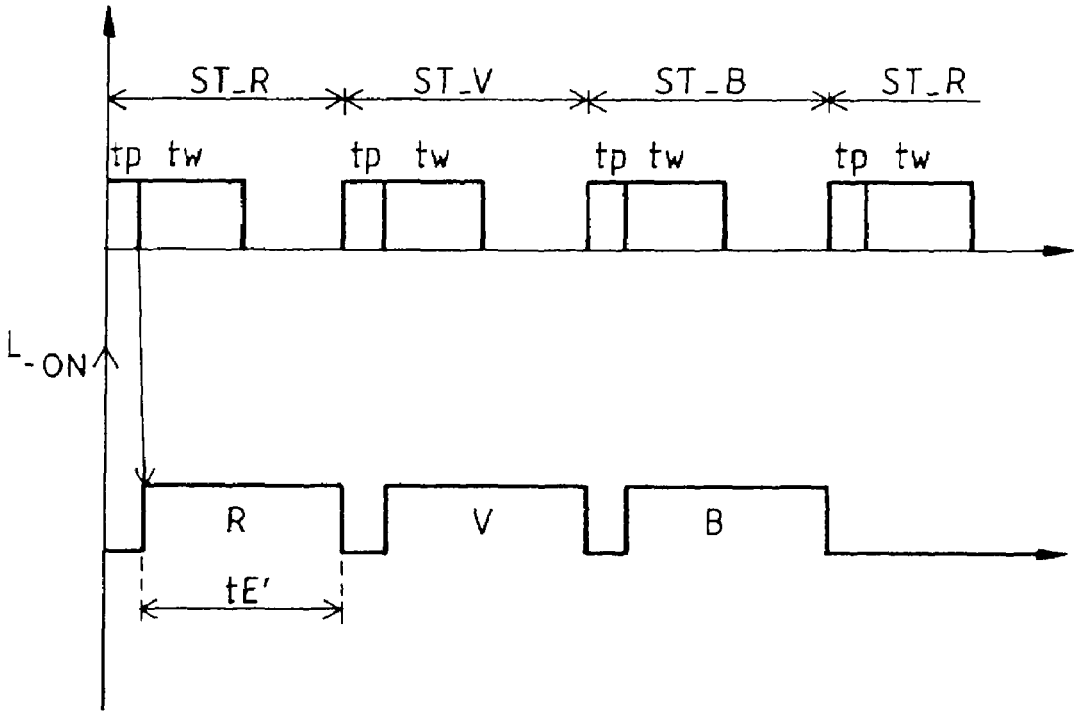

In a first embodiment of the invention shown in FIG. 4*a*, the illumination step is activated (L-on) after the end of the write step in the current addressing phase. Thus, there is an illumination duration $t_E$ for each addressing phase approximately equal to the duration $t_{st}$ of the addressing phase minus the sum of the durations of the precharge step ($t_p$) and the write step ($t_w$). In practice, there is a time $t_i$ between the end of the write step and the corresponding illumination step, to avoid passing information before the liquid crystal of all pixels has stabilised on the last addressed rows in the panel.

In a second embodiment of the invention shown in FIG. 4*a*, the light box is activated (L-on) at the end of the precharge step in the current addressing phase. This embodiment is applicable only if the precharge level is black. In this case, illumination of the light box during the write step is not likely to pass incorrect information, which is not the case with any other precharge level (white or grey).

Thus, there is an illumination duration $t_E'$ for each subframe ST-R, ST-V or ST-B that is approximately equal to the duration $t_{st}$ of the addressing phase. We have seen that the precharge duration $t_p$ during which the light box is off is less than 0.2 microseconds in the case of a precharge to the black level, which is negligible. In practice, the lamp is activated after the end of the precharge step.

The panel illumination time $t_E'$ for each addressing phase is much longer than in the first embodiment (FIG. 4*a*). The brightness of the display is improved.

In the case of precharge to the black level, it is even possible for the light box to be on during precharging. In this case, the light box is on all the time.

Figure 6:
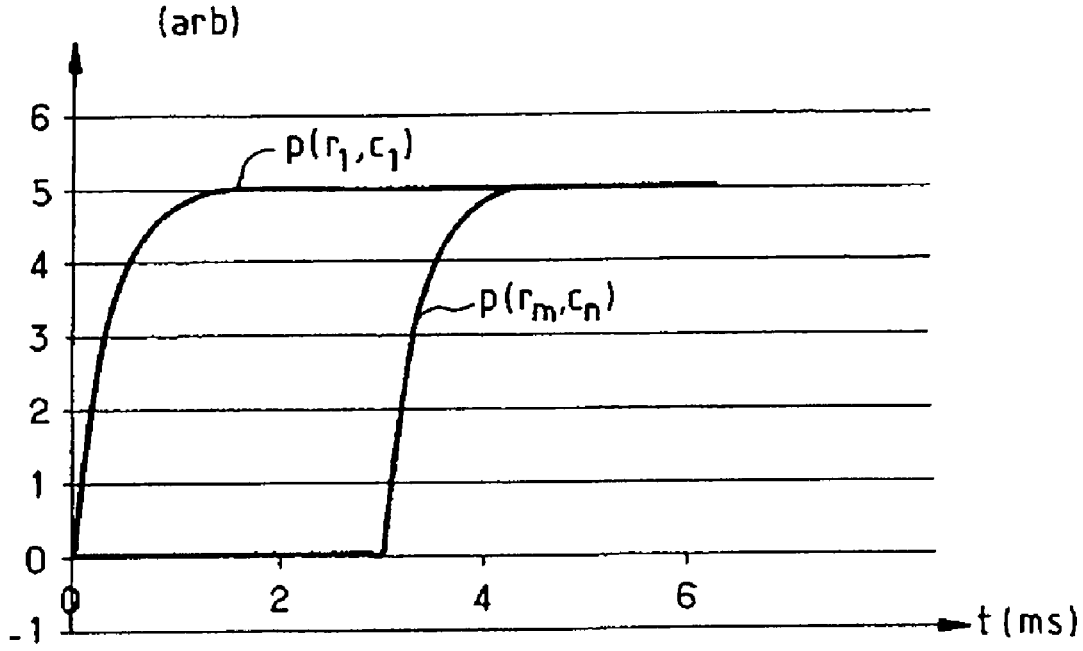
FIG. 6 illustrates the effect of the shade of brightness obtained using an addressing method according to a second embodiment (FIG. 4*b*)

In this context, with the pixels being precharged to the black level and the light box on practically all the time during the addressing phase, and the rows of the matrix selected sequentially one by one, there is a disparity of the brightness of the pixels depending on their position in the display panel and depending on the ordered grey level. Pixels in the first row that is selected firstly during the addressing phase have a white display time m row time longer than the pixels in the m-th row of the panel that is selected last in the addressing phase. There is a strong variation in brightness between the top and the bottom of the panel. FIG. 6 illustrates this disparity of brightness between the first pixel $p(r_1, c_1)$, first row $r_1$ and first column $c_1$, and the last pixel $p(r_m, c_n)$, last row $r_m$ and last column $c_n$, in the display example of white on the first and last pixel in the panel.

Figure 7:
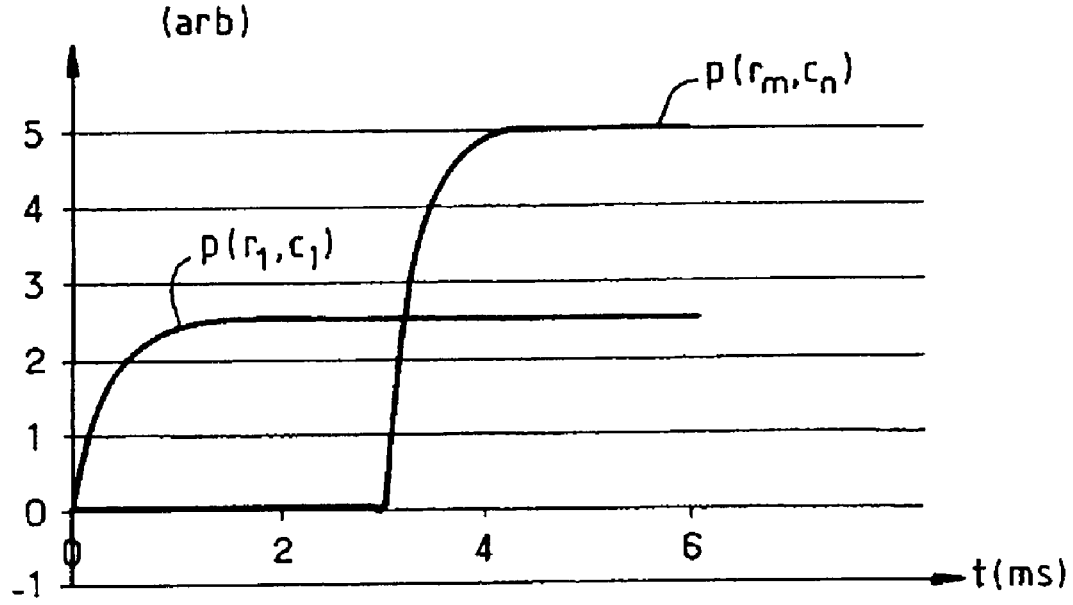
FIG. 7 illustrates compensation of this effect obtained according to an improvement to the invention.

In the invention, it is planned to compensate for this variation in brightness by an adjustment of the analogue voltage switched onto the pixels as a function of the position of these pixels in the panel. To illustrate this compensation, considering the example of white display on the first pixel and the last pixel of the panel and assuming that the brightness of the first pixel $p(r_1,c_1)$ is twice as high as the brightness of the last pixel $p(r_m,c_n)$, the analogue voltage level applied for white is such that the accumulated transmission of this pixel on the illumination time (practically the time of the addressing phase) is only half as much as for the last pixel. This is shown in FIG. 7.

This improvement to the invention is obtained by planning to apply a grey levels scale as a function of the position of the addressed row. This is equivalent to modulating analogue voltage levels $V_1$ to $V_n$ applied onto the columns as a function of the position of the pixel in the panel. This improvement is also applicable in the case of a white precharge. It can improve the quality of the video display.

The grey levels scale is usually calibrated for each panel so as to integrate a so-called gamma compensation (or S curve) to improve the display performances of the display.

Figure 5:
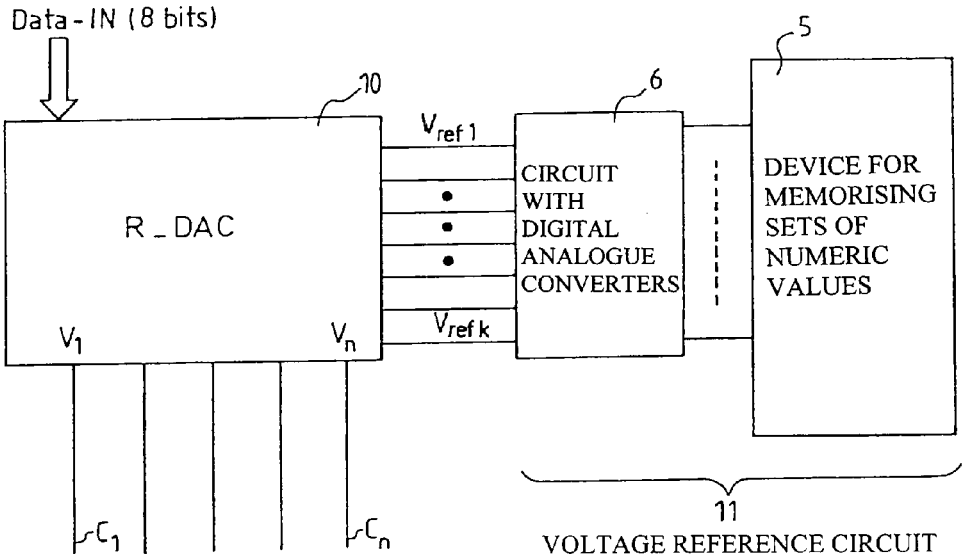
FIG. 5 diagrammatically illustrates a voltage reference circuit used to vary the grey scale as a function of the position of the pixel in a panel.

In the invention, it is planned to adjust this scale as a function of the addressed row. In practice, the values of voltage references $Vref_1$ to $Vref_k$ are modified at the beginning of each new write step. This can be obtained for example by planning a voltage reference circuit 11 (FIG. 2) comprising a device 5 for memorising sets of numeric values, each set coding a grey scale for one or several rows in the panel, as shown diagrammatically in FIG. 5. Preferably, to enable an overdrive type pixel control, each memorised set of digital values that codes a determined grey scale is chosen to enable an overdrive type pixel control mode.

For example, device 5 may be a RAM type memory. It is associated with a circuit 6 with k digital analogue converters that outputs reference analogue values $Vref_1$ to $Vref_k$.

The circuits 10 and 11 are synchronised so that at each write step, there is a set of references $Vref_1$ to $Vref_k$ corresponding to the selected row, at the input to the circuit 10. This can be done by a voltage reference circuit 11 like that described above and shown in FIG. 5, synchronised in an adapted manner.

It is also possible to reverse the vertical scanning direction (row selection direction) of the panel every j addressing phase, where j is a non-zero integer, alone or in combination with this improvement. In particular, in the case of a colour sequential display, the addressing mode can be applied according to the following scheme with inversion of the vertical scanning direction from one video frame to the next, and with the same row selection direction for all sub-frames in the same frame:

frame i:
- red coloured sub-frame: select row $r_1$ to row $r_m$.
- green coloured sub-frame: select row $r_1$ to row $r_m$.
- blue coloured sub-frame: select row $r_1$ to row $r_m$.

frame i+1:
- red coloured sub-frame: select row $r_m$ to row $r_1$.
- green coloured sub-frame: select row $r_m$ to row $r_1$.
- blue coloured sub-frame: select row $r_m$ to row $r_1$.

The selection direction can also be inverted between a coloured sub-frame and the next coloured sub-frame of the same colour. This is particularly applicable in the case in which more than one coloured sub-frame is provided for each primary colour in each video frame.

In an example in which it is planned to divide each image frame into six coloured sub-frames, namely two sub-frames for each primary colour, the following sequence would then be possible:

frame i:
- red coloured sub-frame: select row $r_1$ to row $r_m$.
- green coloured sub-frame: select row $r_1$ to row $r_m$.
- blue coloured sub-frame: select row $r_1$ to row $r_m$.
- red coloured sub-frame: select row $r_m$ to row $r_1$.
- green coloured sub-frame: select row $r_m$ to row $r_1$.
- blue coloured sub-frame: select row $r_m$ to row $r_1$.

frame i+1:
- red coloured sub-frame: select row $r_1$ to row $r_m$.
- green coloured sub-frame: select row $r_1$ to row $r_m$.
- blue coloured sub-frame: select row $r_1$ to row $r_m$.
- red coloured sub-frame: select row $r_m$ to row $r_1$.
- green coloured sub-frame: select row $r_m$ to row $r_1$.
- blue coloured sub-frame: select row $r_m$ to row $r_1$.

The invention that has just been described is applicable to any display for which it is required to improve the brightness or energy consumption at constant brightness. It is also applicable to displays that comprise only one addressing phase per video frame, with dynamic white light illumination on a panel for which the structure does or does not have coloured filters. It is also applicable to displays using an addressing mode in which m rows in the panel are each selected one after the other, or in which several rows may be selected at the same time. This is possible particularly in a matrix display with sequential colours display of the active matrix type, in which rows are distributed in p groups and in which each pixel column comprises p column conductors enabling selection of pixels in p rows in parallel in write, with one row per group. For example, each group may comprise m/p successive rows in the panel, such that the display is organised into p bands of m/p rows.

It will be readily seen by one of ordinary skill in the art that the present invention fulfills all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by the definition contained in the appended claims and equivalent thereof.

The invention claimed is:

1. A video system comprising:

a liquid crystal display that displays a video frame including:

a panel of pixels arranged in rows and columns, each row corresponding to a phase of a plurality of addressing phases, and at least one phase of the plurality of addressing phases in the panel being included in the video frame;

a write rows unit configured to select the row during a row time and apply an analog voltage level corresponding to image data to be displayed, on each pixel in the selected row;

an illumination unit, including a light box, configured to illuminate the pixels; and a precharge unit configured to precharge the pixels in the display, and to apply a precharge voltage onto all pixels, the precharge being activated in sequence at the beginning of each addressing phase before the write rows unit selects the row, and the precharge unit including a precharge circuit comprising a plurality of row transistors, one for each row, and a plurality of column transistors, one for each column, the row transistors and column transistors being activated simultaneously in the precharging performed by the precharge unit, the row transistors selecting all rows in the panel simultaneously, and the column transistors applying a precharge voltage to all columns simultaneously in response to the activation of the row and column transistors.

2. The video system according to claim 1, wherein the polarity of the precharge voltage is inverted for each addressing phase.

3. The video system according to claim 2, wherein the precharge voltage corresponds to the white level and the light box is switched off during the precharge operation.

4. The video system according to claim 3, wherein in each addressing phase, the illumination operation is activated after the write operation.

5. The video system according to claim 2, wherein the precharge voltage corresponds to a black level and the light box is switched off during the precharge operation.

6. The video system according to claim 1, wherein the precharge voltage corresponds to a white level and the light box is switched off during the precharge operation.

7. The video system according to claim 6, wherein in each addressing phase, the illumination operation is activated after the write operation.

8. The video system according to claim 1, wherein the precharge voltage corresponds to a black level and the light box is switched off during the precharge operation.

9. The video system according to claim 8, wherein in each addressing phase, the illumination operation and the write operation are activated substantially simultaneously.

10. The video system according to claim 1, wherein the precharge level is a black level and the light box is switched on during the precharge.

11. The video system according to claim 1, wherein for a given grey level to be displayed on a precharged pixel, an analog voltage level value to be applied onto a corresponding column is modulated as a function of the position of the pixel corresponding row in the panel.

12. The video system according to claim 11, an analog voltage being applied to each pixel in a selected row in the write operation using a digital to analog conversion circuit and a set of reference analog voltage values coding a grey scale, wherein the write operation includes selection of a set of reference analog voltage values depending on the position of the selected current row in the panel.

13. The video system according to claim 12, wherein reference analog voltage values are determined to enable an overdrive type pixel control mode.

14. The video system according to claim 1, wherein a selection direction of rows in the panel is reversed every j addressing phase, j being a non-zero integer.

15. The video system according to claim 1, including a liquid crystal display in sequential color mode, a video frame including at least one colored sub-frame for each primary color, wherein the addressing phase is repeated for each colored sub-frame in a video frame.

16. The video system according to claim 15, wherein a direction of selection of rows in the panel is alternated from one video frame to the next or, within a specific video frame, between the colored sub-frames of the same color.

17. The video system according to claim 1, wherein the row transistors and column transistors in the precharge circuit are built into or are outside the display.

18. The video system according to claim 1, wherein the row transistors are diode-mounted.

19. A video system comprising:

a liquid crystal display comprising a panel of pixels arranged in rows and columns, a video frame including at least one addressing phase of the rows in the panel including:

a write rows operation, containing a phase for each row to select the row during a row time and apply an analog voltage level corresponding to image data to be displayed, on each pixel in the selected row;

an illumination operation using a light box capable of illuminating the pixels; and a precharge operation to precharge the pixels in the display, to apply a precharge voltage onto all pixels;

wherein the precharge operation is activated in sequence at the beginning of each addressing phase before the write rows operation, and the precharge operation is achieved by a precharge circuit comprising a plurality of row transistors, one for each row, and a plurality of column transistors, one for each column, the row transistors and column transistors being activated simultaneously in the precharge operation, row transistors to select all rows in the panel simultaneously, and column transistors to apply a precharge voltage to all columns simultaneously, wherein the row transistors are diode-mounted.

* * * * *